US011053772B2

(12) United States Patent
Parks

(10) Patent No.: US 11,053,772 B2
(45) Date of Patent: Jul. 6, 2021

(54) METHODS AND SYSTEMS FOR PREVENTING HYDROSTATIC HEAD WITHIN A WELL

(71) Applicant: Vertice Oil Tools, Missouri City, TX (US)

(72) Inventor: Stephen Parks, Houston, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 0 days.

(21) Appl. No.: 17/162,559

(22) Filed: Jan. 29, 2021

(65) Prior Publication Data

US 2021/0148187 A1 May 20, 2021

Related U.S. Application Data

(63) Continuation of application No. PCT/US2020/013611, filed on Jan. 15, 2020, which is a continuation of application No. 16/571,112, filed on Sep. 14, 2019, now Pat. No. 10,662,734.

(51) Int. Cl.
*E21B 33/128* (2006.01)
*E21B 33/127* (2006.01)

(52) U.S. Cl.
CPC ..... *E21B 33/1285* (2013.01); *E21B 33/127* (2013.01); *E21B 33/128* (2013.01)

(58) Field of Classification Search
CPC .. E21B 33/127; E21B 33/1208; E21B 33/128; E21B 33/126; E21B 33/1285
See application file for complete search history.

(56) References Cited

U.S. PATENT DOCUMENTS

| | | | | |
|---|---|---|---|---|
| 6,640,893 | B1 * | 11/2003 | Rummel | E21B 33/1208 166/187 |
| 6,843,315 | B2 | 1/2005 | Coronado | |
| 7,306,033 | B2 * | 12/2007 | Gorrara | E21B 33/127 166/187 |
| 7,588,077 | B2 * | 9/2009 | Harper | E21B 33/1212 166/191 |
| 7,669,653 | B2 | 3/2010 | Craster | |
| 9,863,208 | B2 * | 1/2018 | Martin | F16J 15/08 |
| 10,006,257 | B2 * | 6/2018 | Logan | E21B 17/00 |
| 10,060,222 | B2 * | 8/2018 | Saltel | E21B 33/127 |
| 10,125,567 | B2 * | 11/2018 | Martin | E21B 33/1292 |
| 10,662,734 | B1 * | 5/2020 | Parks | E21B 33/127 |
| 2006/0042801 | A1 * | 3/2006 | Hackworth | E21B 33/13 166/387 |
| 2007/0089877 | A1 * | 4/2007 | Corre | E21B 33/1277 166/187 |
| 2008/0251250 | A1 * | 10/2008 | Brezinski | E21B 43/103 166/179 |
| 2012/0125619 | A1 * | 5/2012 | Wood | E21B 43/267 166/308.1 |

(Continued)

FOREIGN PATENT DOCUMENTS

WO WO-2005088064 A1 * 9/2005 ..... E21B 43/105

*Primary Examiner* — Daniel P Stephenson
(74) *Attorney, Agent, or Firm* — Pierson IP, PLLC

(57) ABSTRACT

A tool with a deformable element that is configured to flex across an annulus based on a force being applied to an inner surface of the deformable element. The deformable element may be configured to be positioned within a chamber that is covered by a first rupture disc. The deformable element may include seals, flex joints, and a body.

22 Claims, 8 Drawing Sheets

(56) References Cited

U.S. PATENT DOCUMENTS

| | | | | |
|---|---|---|---|---|
| 2012/0312555 | A1* | 12/2012 | Caminari | E21B 23/00 166/381 |
| 2014/0196887 | A1 | 7/2014 | Hallundbæk | |
| 2015/0090439 | A1* | 4/2015 | VanLue | E21B 33/134 166/118 |
| 2016/0053568 | A1* | 2/2016 | Saltel | E21B 23/06 166/179 |
| 2016/0102522 | A1 | 4/2016 | Martin | |
| 2017/0211348 | A1* | 7/2017 | Buyers | E21B 33/1216 |

* cited by examiner

METHODS AND SYSTEMS FOR PREVENTING HYDROSTATIC HEAD WITHIN A WELL

BACKGROUND INFORMATION

Field of the Disclosure

Examples of the present disclosure relate to a deformable element that is configured to seal across an annulus by deformation. More specifically, embodiments include a deformable element that is configured to flex across an annulus responsive to being introduced to pressure force.

Background

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Conventionally, casings can be run all way to the surface which adds an extra cost of casing length. Other methods can include hanging the casing just above the horizontal or deviated section using a packer, a liner hanger, combination of both. Although this can be a cheaper method, it is still expensive and increases operational complexity. Alternative methods include running the casing all the way to the surface, then intervening with mechanical or chemical cuts to sever the casing at a point above the horizontal section. However, this provides uncertainty of a shape and condition of the severed portion for re-entry purposes.

Furthermore, in re-frac applications or casing in casing applications, the original casing can have existing perforations that are connecting to the reservoir. This may cause pressure to be depleted due to production, and a conventional packer to isolate top sections of the liner may be required to prevent hydrostatic head from acting on uncured cement. This causes the liner to drop/move and expose the original perforations to new treating pressure. However, conventional packers require significant size/real estate to compensate for the piston needed to activate them.

Accordingly, needs exist for systems and methods associated with a deformable element that is configured to flex across an annulus based on a pressure being applied to an inner surface of the deformable element.

SUMMARY

Embodiments disclosed herein describe systems and methods for a tool with a deformable element that is configured to flex across an annulus based on a pressure being applied to an inner surface of the deformable element. This may eliminate the need for a significant increase in the outside diameter or decrease of the inner diameter of the tool, which may allow embodiments to occupy smaller spaces while maximizing the internal diameter through the tool. The deformable element may be configured to be positioned within a chamber that is covered by a first rupture disc. The deformable element may include seals, flex joints, and a body. In other embodiments, the rupture disc may be replaced with check valve or any other temporarily barrier.

The seals may be positioned on a proximal and distal end of an inner surface of the body against an outer surface of the tool. The inner surface of the tool may be partial seals configured to limit communication from an area between the inner surface of the body and the rest of the chamber without forming an atmospheric chamber, which can be also accomplished through the installation of check valve. In embodiments, the seal positioned on proximal or the distal end may be a complete seal.

The flex joints may be indentations, grooves, etc. positioned on an outer surface of the deformable element extending towards the inner surface. The flex joints may be configured to create weak points where the deformable element may flex outward across the annulus, which may allow the deformable element to bend but not break. The flex joints may be positioned between the seals. In other embodiments, the flex joints may be outside of the seals, positioned closer to the ends of the deformable element.

The body of the deformable element may extend from a first flex joint to a second flex joint, and include two tapered portions and a stem, wherein the stem is positioned between the two tapered portions. The tapered portions may be configured to increase and decrease, the diameter across the body to reduce the diameter across the stem, respectively. This may allow for stem to move from a first position that is in parallel to a central axis of the tool, to a second position that is bowed, flexed, etc. outward across the annulus. The outer surface of the body of the deformable element may be coupled with a compressible, resilient, high tensile strength materials, such as rubber. In other embodiments, the deformable element may not be coupled with any other materials.

In embodiments, responsive to the first rupture disc that isolates the chamber from the inner diameter of the tool being removed, the inner surface of the body may receive a force from the initial rupture and from fluid flowing through the inner diameter of the tool. This may cause the stem to bow outward to increase a distance from the outer diameter of the tool to the inner surface of the body, which may form a seal across the annulus. In embodiments, responsive to decreasing the force against the inner surface of the body, the stem may no longer bow outward and be reset in the direction that is in parallel to the central axis of the tool. In other embodiments, responsive to flexing the stem across the annulus, the stem may not fully retract even if the force is no longer being applied to the inner surface of the body due to reaching the plastic yield of the material which makes the stem permanently in a flex position.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
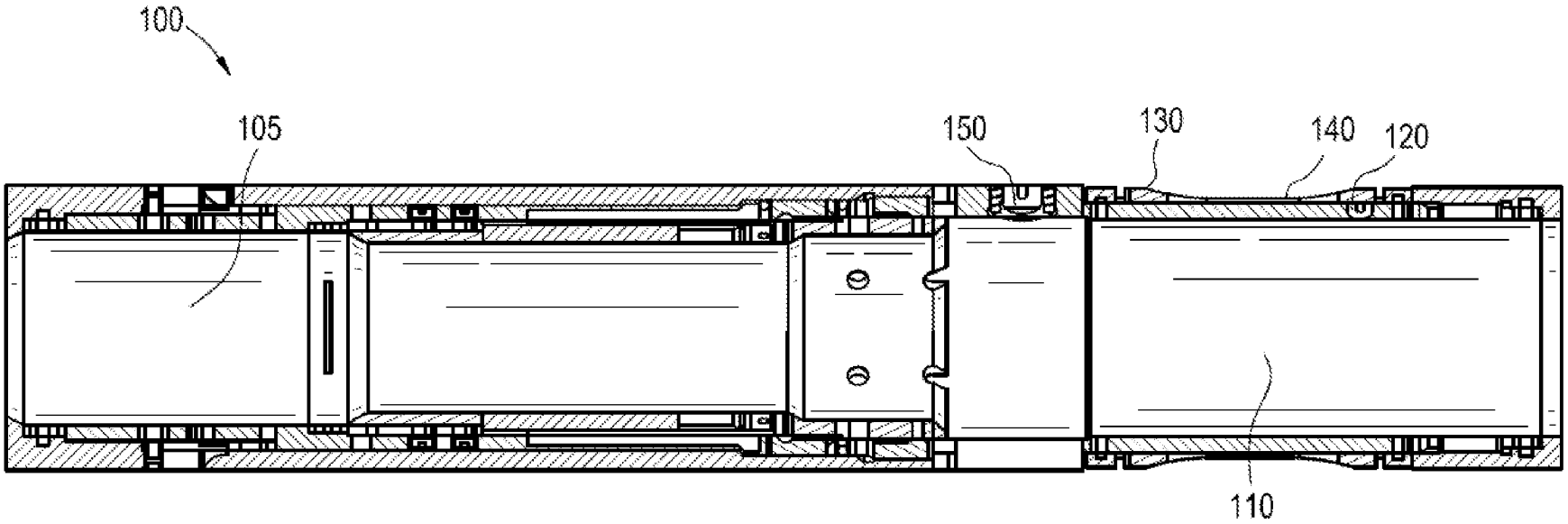
FIG. 1 depicts a tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a tool 100 for sealing an annulus, according to an embodiment. Tool 100 may be used in connection with further elements, as described in U.S. Ser. No. 16/423,367 filed on May 28, 2019, and U.S. Pat. No. 10,400,521 granted on Sep. 3, 2019, which are hereby incorporated by reference in its entirety. More specifically, tool 100 may be configured to seal across an annulus before/after an upper sub-assembly 105 is decoupled from a lower sub-assembly 110 and/or before an inner diameter of tool 100 is in communication with the annulus outside of tool 100. Tool 100 may include upper sub assembly 105 and lower sub assembly 110, which may be configured to be run in hole as an integral unit, and decoupled from each other. Lower sub-assembly 110 may include a first rupture disc 120, deformable element 130, outer surface 140, and second rupture disc 150.

First rupture disc 120 may be positioned between an inner diameter of lower sub-assembly 110 and a housing of deformable element 130. First rupture disc 120 may be configured to be removed after a pressure differential across first rupture disc 120 is greater than a first pressure threshold. In further embodiments, rupture disc 120 may be formed of dissolvable materials or any other temporarily element that are configured to be removed after a predetermined amount of time, temperature, and/or being interfaced with fluids, etc.

Deformable element 130 may be a device formed of rigid materials, such as metal, that is configured to move from a first mode to a second mode. Deformable element 130 may be a continuous piece of ductile material that is configured to be plastically inflated/deformed. Deformable element 130 may be configured to move between the first mode and the second mode after first rupture disc 120 has been removed, and responsive to fluid creating a force on an inner surface of deformable element 130. The sudden pressure from rupture disc 120 and the flowing fluid may create a force against the inner surface of deformable element that is radial from the inner diameter of the tool towards the inner surface of casing. In the first mode, deformable element 130 may be configured to extend in a direction substantially in parallel to a central axis of lower sub-assembly 110. In the second mode, the middle of the deformable element 130 may be configured to flex, bow, etc. outward to seal/choke across an annulus while the ends of the deformable element 130 remain parallel to a central axis of lower sub-assembly 110. Furthermore, in the second mode a distance between the outer surface 140 of lower sub-assembly 110 and the inner surface of deformable element 130 may increase. In the second mode, the distance between the outer surface 140 of the lower sub assembly 110 and the inner diameter of the original casing it run through may decrease. In further embodiments, Deformable element 130 may be formed of a single material, such as steel, or a combination of materials coupled together. The plurality of materials may be coupled together to allow variation in material properties, such as strength, ductility, or to allow flex points at desired locations based on the mechanical properties of the materials at different locations.

Second rupture disc 150 may be positioned between the inner diameter of lower sub-assembly and the annulus. Second rupture disc 150 may be configured to be removed after a pressure differential across second rupture disc 150 is greater than a second pressure threshold, wherein the second pressure threshold is greater than the first pressure threshold. As such, communication to the annulus through a chamber housing second rupture disc 150 may be formed after both first rupture disc 120 and second rupture disc 150 are removed. In further embodiments, second rupture disc 150 may be formed of dissolvable materials that are configured to be removed after a predetermined amount of time, being interfaced with fluids, etc.

Figure 2:
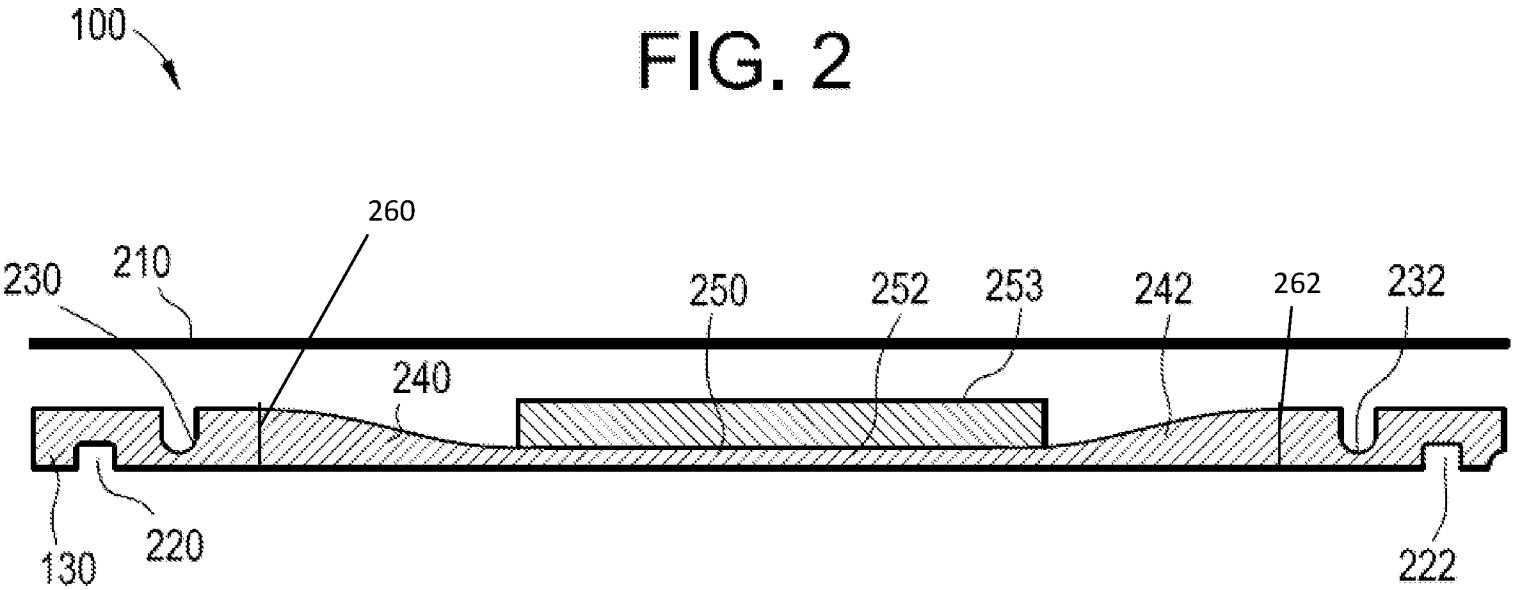
FIG. 2 depicts a tool, according to an embodiment.

FIG. 2 depicts deformable element 130 in a first mode, according to an embodiment. As depicted in FIG. 2, in the first mode, an outer surface of deformable element 130 may be positioned away from an inner surface of casing 210. Accordingly, in the first mode, fluid may flow between the outer surface of deformable element 130 and casing 210 without restriction. Deformable element 130 may include seals 220, 222, flex joints 230, 232, and a body 250.

The seals 220, 222 may be positioned on a proximal and distal end of an inner surface of the body 250, and be positioned against an outer surface of the tool. The seals 220, 222 may be partial seals configured to limit communication from an area between the inner surface of the body 250 and the rest of the annulus without forming an atmospheric chamber. In embodiments, a first seal 220 positioned on proximal or the distal end may be a partial seal, while a second seal 222 positioned on the opposite end of body 250 may be a complete seal.

The flex joints 230, 232 may be indentations, grooves, etc. positioned on an outer surface of deformable element 130 extending towards the inner surface of deformable element 130. Flex joints 230, 232 may be configured to be weak points where deformable element 130 may flex outward across the annulus, which may allow deformable element 130 to bend, yield or deform but not break. In embodiments, flex joints 230, 232 may be positioned between seals 220, 222. In further embodiments, flex joints 230, 232 may be symmetrical in shape, with a substantially "U-Shape." The shape of flex joints 230, 232 may further control the flexing of body 250. In other embodiments, the seals 220, 222 may be positioned between the flex joints 230,232.

Body 250 may include two tapered portions 240, 242 positioned between flex joints 230, 232, and a stem 252 positioned between tapered portions 240, 242. Tapered portions 240, 242 may decrease a diameter across the metal body 250 to control the flexing of body 250 at stem 252. Due to the decrease in diameter across stem 252 versus that of tapered portions 240, 242, stem 252 may flex more outer ward then the rest or body 250. In embodiments, weep holes 260, 262, check valves, or one-way valves may be positioned through body 250. The valves may be configured to allow communication from the inner surface of body 250 and the annulus, while limiting communication from the annulus to the inner surface of body 250. This may assist in not forming an atmospheric chamber between the inner surface of body 250 and first rupture disc 120. In embodiments, body 250 may have a substantially planner inner surface when run in hole, wherein the inner surface of body 250 may be configured to be position adjacent to an outer surface of a mandrel before body 250 is deformed. Before being deformed, an outer surface of body 250 may have a concave curvature. Once body 250 is deformed, the outer surface of body 250 may have a convex curvature.

Figure 3:
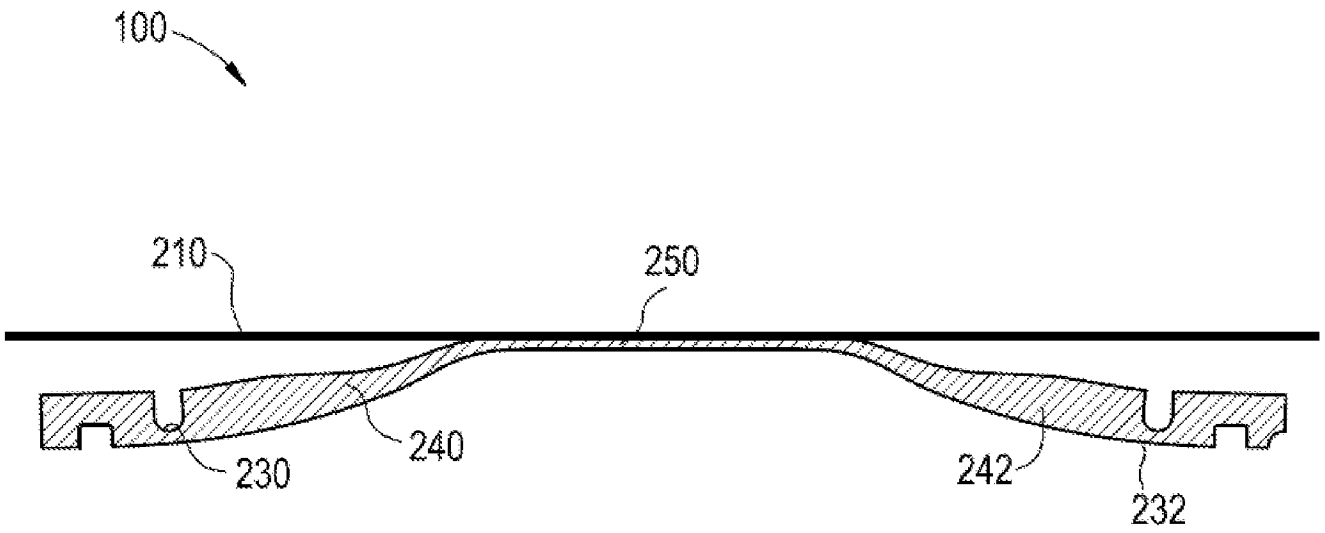
FIG. 3 depicts a tool, according to an embodiment.

In other embodiments, elastic material 253 may be coupled, mounted, glued, etc. to an outer surface of the stem 252, elastic material 253 may extend between tapered portions 240, 242240 to 242. Elastic material 253 may be a rubber, Teflon or any other elastic material that has the ability to deform and seal gaps. FIG. 3 depicts deformable element 130 in a second mode, according to an embodiment. In embodiments, responsive to the first rupture disc being removed, the inner surface of deformable element 130 may be configured to interface with fluid flow, pressure, or both within the inner diameter of the chamber, which may cause a force against the inner surface of deformable element 130. This force may cause deformable element 130 to flex outward, the flex, bow or deformation may be permanent if it exceeds the max yield strength of deformable element 130.

As depicted in FIG. 3, when the force is applied to the inner surface of deformable element 130, body 250 may begin to flex at the weak points created by flex joints 230, 232, and continue to flex at an increasing angle along tapered portions 240, 242. This may allow the outer surface of body 250 to be positioned adjacent to casing 210. In other embodiment body 250 outer diameter may be coupled to a rubber, elastic element, this may allow body 250 to flex less and allow the outer surface of stem 252 or elastic element 253 to contact the casing 210, which may form a seal across the annulus.

Figure 4:
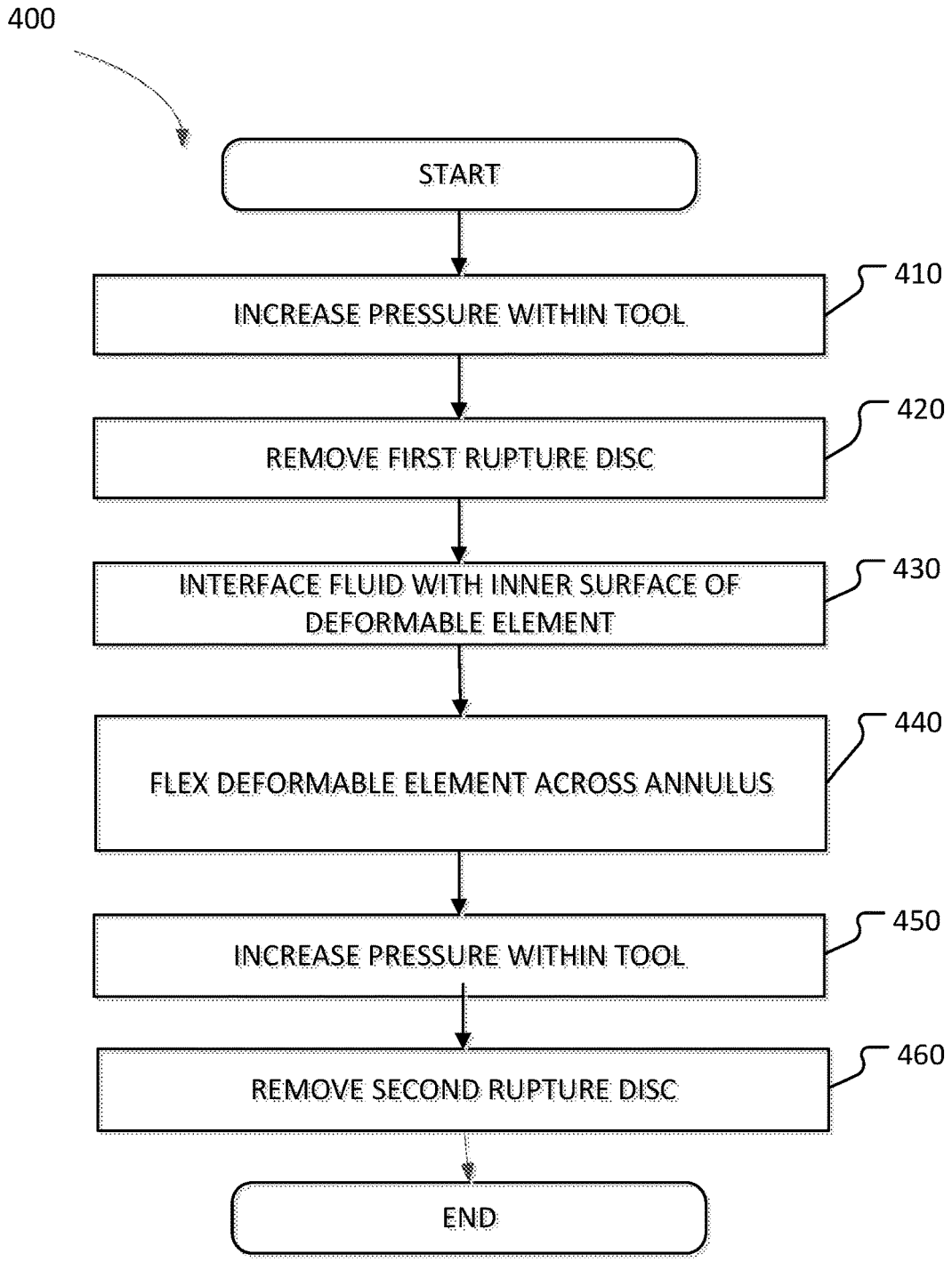
FIG. 4 depicts a method for using a tool, according to an embodiment.

FIG. 4 depicts a method 400 for deforming a tool, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, pressure within a tool may be increased by flowing fluid within a tool.

At operation 420, responsive to the pressure increasing within the tool, the force created by the fluid flowing, the pressure across a first rupture disc being greater than a first pressure differential, etc., the first rupture disc may be removed.

At operation 430, the fluid may flow through a chamber housing the first rupture disc and interact with an inner surface of a deformable element.

At operation 440, responsive to the fluid interacting with the inner surface of the deformable element, the deformable element may flex at flex joints and across tapered portions of the deformable element. By controlling the diameter across the deformable element at various locations, the outward flex of the deformable element may be controlled to flex but not break, wherein the deformable element may flex across an annulus such that an outer surface of the deformable element is positioned adjacent to inner diameter of casing.

At operation 450, the pressure within the tool may further increase.

At operation 460, responsive to the pressure within the tool increasing further, a second rupture disc may be removed. This may allow communication through a housing initially holding the second rupture disc, wherein the communication is allowed between an inner diameter of the tool and the annulus.

Figure 5:
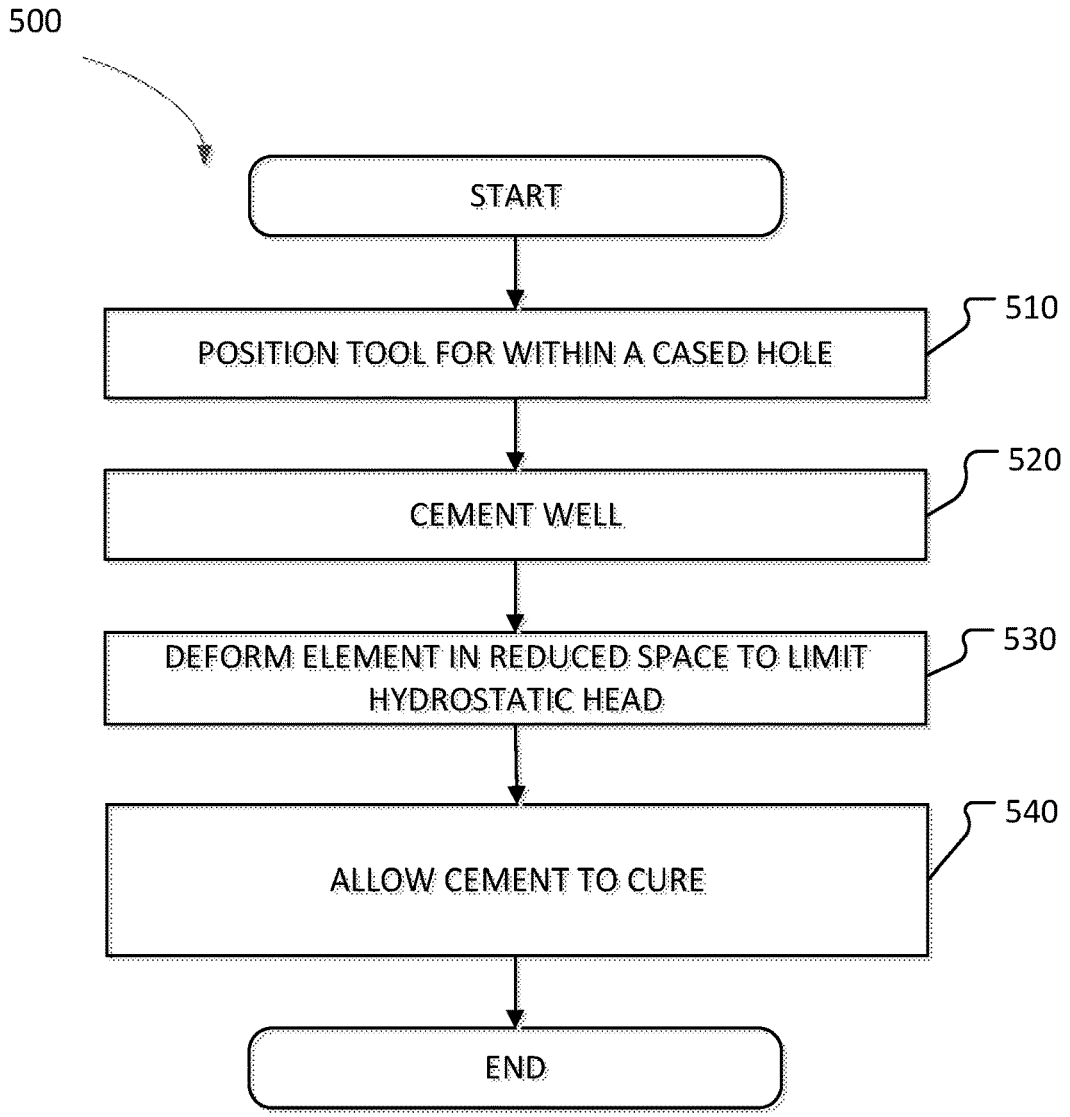
FIG. 5 depicts a method for using a tool, according to an embodiment.

FIG. 5 depicts a method 500 for deforming a tool, according to an embodiment. The operations of method 400 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting.

At operation 510, a tool may be positioned downhole within a cased hole or an open hole. The cased hole may be positioned downhole within a geological formation that has already produced, and includes fractures that are created by a perforation gun. In other embodiment the geological formation may be not produced at the time of position the tool.

At operation 520, cement may be pumped through the tool, followed by a wiper plug. This may force the cement to fill up an annulus positioned between an outer diameter of the tool and an inner diameter of the cased hole. However, there may be a hydrostatic head creating a pressure on an upper surface of the cement that is not cured. Without any further forces impacting the cement, this hydrostatic head may force the well to drink and move the cement downhole, which may not allow the cement to be cured at desired locations.

At operation 530, a deformable element may expand across the annulus at a location above an upper surface of the cement. By expanding the deformable element, the deformable element may create a sufficient enough force to isolate the annulus above from the annulus below, which prevents the hydrostatic head from acting on the cement head or set packers, it may be necessary to deform existing materials at a kickoff point to form the seal to limit the real estate required for elements in a narrower casing.

At operation 540, the cement below the deformable element may cure. By expanding the deformable element above the upper surface of the cement in a refracturing operation, the cement may not drop downhole due to the hydrostatic head applying forces against the upper surface of the cement.

Figure 6:
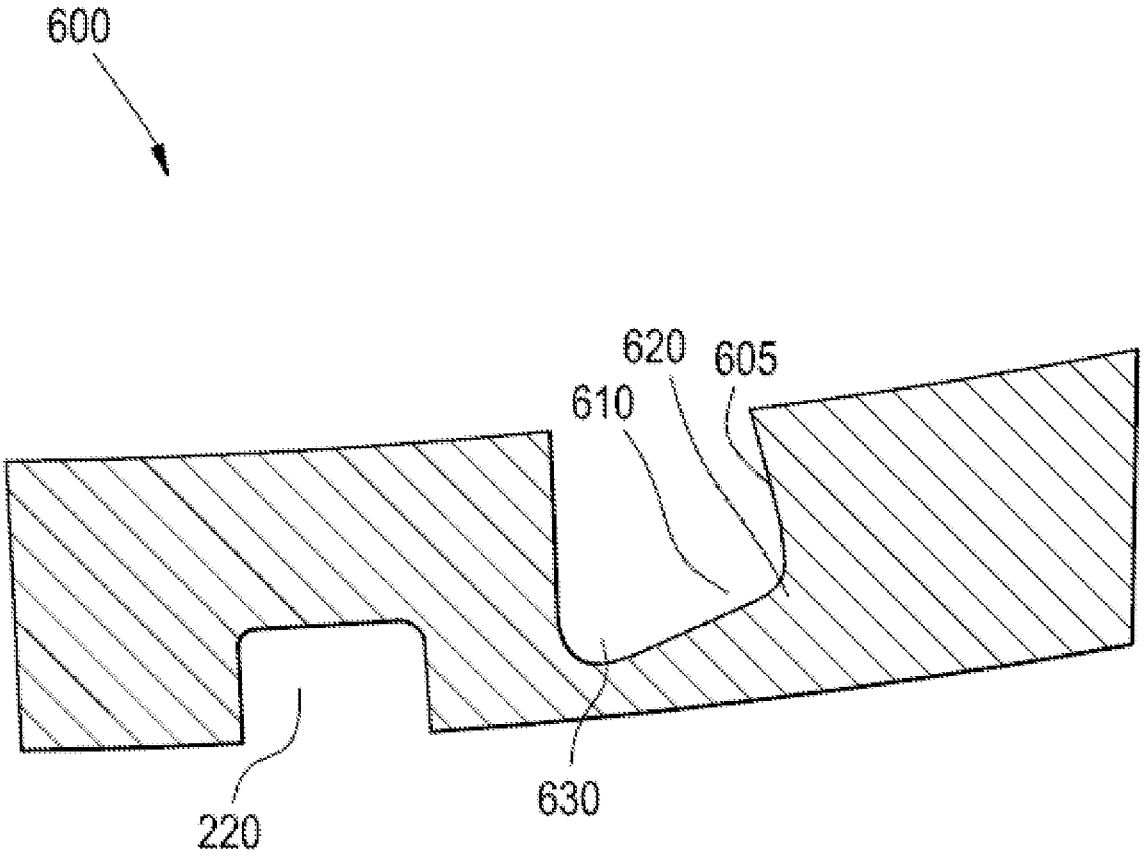
FIG. 6 depicts a tool, according to an embodiment.

FIG. 6 depicts a deformable body 600, according to an embodiment. Elements depicted in FIG. 6 may be described above, and for the sake of brevity a further description of these elements is omitted.

As depicted in FIG. 6 deformable body 600 may include an asymmetric flex joint 605. Flex joint 605 may include two asymmetrical curves 620, 630 with a lower sidewall that is tapered 610. This may allow for the deformation of deformable body 600 to occur at lower stresses in a given direction than when compared to a symmetrical flex joint 605.

Figure 7:
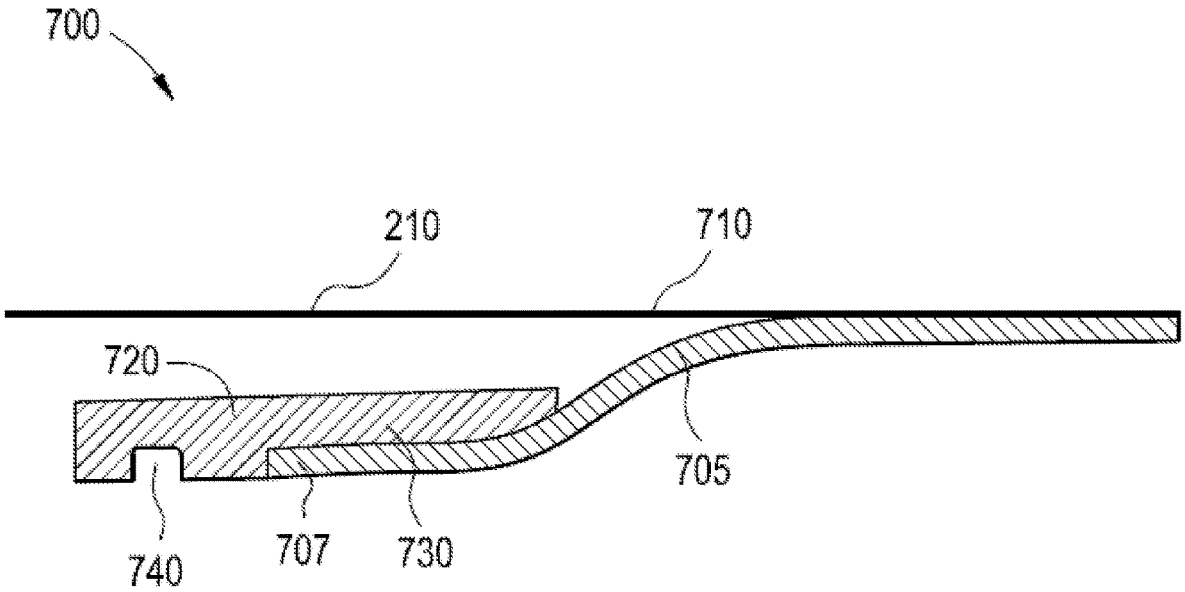
FIG. 7 depicts a tool, according to an embodiment.

FIG. 7 depicts a system 700 configured to deform across an annulus to contact an inner surface of casing 710, according to an embodiment. Elements depicted in FIG. 7 may be described above, and for the sake of brevity a further description of these elements is omitted. System 700 may include a retaining body 720 and a deformable element 705.

Retaining body 720 may include a seal 740 and ledge 730, wherein ledge 730 may be an outcrop, projection etc. In embodiments, seal 740 may be configured to be positioned adjacent to an outer diameter of a tool, while ledge 730 may be positioned away from the outer diameter of the tool. An end 707 of a deformable element 705 may be configured to be positioned between ledge 730 and the outer diameter of the tool, and be secured to ledge 730 and the outer diameter of the tool. Responsive to the inner surface of deformable element 705 receiving a force to deform, deformable element 705 may flex outward to seal across the annulus to be positioned adjacent to casing 710. When flexed across the annulus, the end 707 of deformable body 705 may remain positioned between ledge 730 and the outer diameter of the tool.

Figure 8:
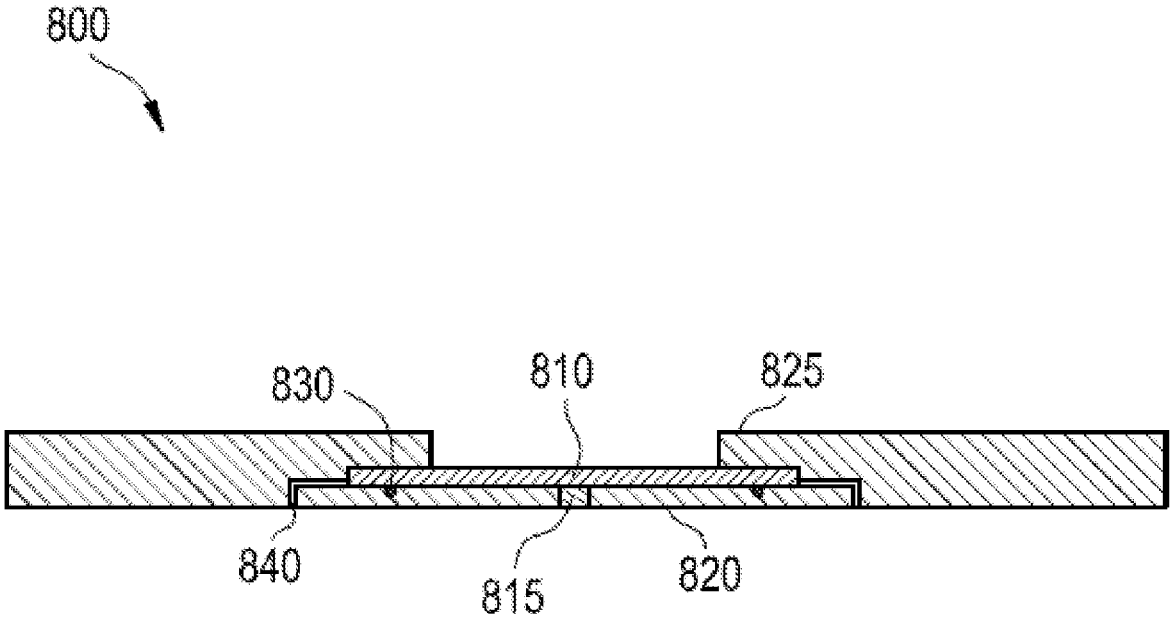
FIG. 8 depicts a tool, according to an embodiment.

FIG. 8 depicts a system 800 configured to deform across an annulus to contact an inner surface of casing, according to an embodiment. Elements depicted in FIG. 8 may be described above, and for the sake of brevity a further description of these elements is omitted. System 800 may include a deformable element 810, rupture disc 815, mandrel 820 with ledge 825, seals 830, and ports 840.

Deformable element 810 may be configured to be positioned within mandrel 820, wherein at least a portion of the upper surface of deformable element 810 is exposed to an annulus. This portion of the upper surface of the deformable element may be configured to flex across the annulus to seal the annulus. The ends of deformable element 810 may be configured to be encompassed and secured in place by mandrel 820 and the ledge 825 of mandrel.

Seals 830 may be positioned between the lower surface of deformable element 810 and mandrel 820, wherein seals 830 may be configured to limit communication between the inner diameter of system 800 and a lower surface of deformable element 810. In other embodiments, the seals may be configured on the deformable element 810, the ledge 825 or next to the element proximal end and distal end.

Ports 840 may be configured to allow communication from an inner diameter of system 800 towards a lower surface of deformable element 810. The communication may assist in flexing deformable element 810 across the annulus after rupture disc 815 is removed. In other embodiment that rupture disc may be replaced with a hole.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A downhole tool configured to be used in zonal isolation operations comprising:

a deformable element with a stem configured to move from a first mode to a second mode, wherein in a first mode the stem has a first outside diameter and in the second mode the stem is permanently deformed to have a second outside diameter, the second outside diameter being larger than the first outside diameter, wherein in the first mode an inner surface of the stem is not flexed and in the second mode the inner surface of the stem is flexed to create a convex bend;

a tapered slope increasing a diameter across the deformable element from a center the stem towards an end of the deformable element, wherein a thickness associated with the center of the stem is smaller than that of the tapered slope, wherein the center of the stem is positioned closer to a central axis of the downhole tool than an outer surface of the tapered slope.

2. The downhole tool of claim 1, wherein in the first mode the inner surface of the stem extends in a direction in parallel to a central axis of the downhole tool.

3. The downhole tool of claim 1, further comprising:

indentations extending from an outer surface of the deformable element towards an inner surface of the deformable element, the inner surface of the deformable element positioned closer to a central axis of the downhole tool than the outer surface of the deformable element;

an elastic material positioned on the outer surface of the deformable element.

4. The downhole tool of claim 1, wherein the tapered slope includes two angled ends.

5. The downhole tool of claim 1, wherein the tapered slope is positioned between the end of the deformable element and the center of the stem.

6. The downhole tool of claim 1, further comprising:

a retaining body with a ledge, wherein the end is configured to be positioned between a tool mandrel and the ledge.

7. The downhole tool of claim 1, further comprising:

a hole configured to expose the internal diameter of the deformable element to an inner diameter of the downhole tool.

8. A method associated with a downhole tool configured to be used in zonal isolation operations, the method comprising:

moving a deformable element with a stem from a first mode to a second mode, wherein in a first mode the stem has a first outside diameter and in the second mode the stem is permanently deformed to have a second outside diameter, the second outside diameter being larger than the first outside diameter, wherein in the first mode an inner surface of the stem is not flexed and in the second mode the inner surface of the stem is flexed to create a convex bend;

forming a tapered slope that increases a diameter across the deformable element from a center the stem towards an end of the deformable element, wherein a thickness associated with the center of the stem is smaller than that of the tapered slope, wherein the center of the stem is positioned closer to a central axis of the downhole tool than an outer surface of the tapered slope.

9. The method of claim 8, wherein in the first mode the inner surface of the stem extends in a direction in parallel to a central axis of the downhole tool.

10. The method of claim 8, further comprising:

forming indentations extending from an outer surface of the deformable element towards the inner surface of the deformable element, the inner surface of the deformable element positioned closer to a central axis of the downhole tool than the outer surface of the deformable element;

positioning an elastic material positioned on the outer surface of the deformable element.

11. The method of claim 8, wherein the tapered slope includes two angled ends.

12. The method of claim 8, wherein the tapered slope is positioned between the end of the deformable element and the center of the stem.

13. The method of claim 8, further comprising:

positioning the end between a tool mandrel and a ledge.

14. The method of claim 8, further comprising:

gorming a hole to expose the internal diameter of the deformable element to an inner diameter of the downhole tool.

15. A downhole tool configured to be used in zonal isolation operations comprising:

a deformable element with a stem configured to move from a first mode to a second mode, wherein in a first mode the stem has a first length and in the second mode the stem is permanently deformed to have a second length, the second length being shorter than the first length, wherein in the first mode an inner surface of the stem is not flexed and in the second mode the inner surface of the stem is flexed to create a convex bend;

a flex joint extending from an outer surface of the body towards the inner surface of the stem, the inner surface of the stem positioned closer to a central axis of the downhole tool than the outer surface of the stem; and a tapered slope increasing a diameter across the body from a center the stem towards ends of the deformable element, wherein a thickness associated with the center of the stem is smaller than that of the tapered slope, wherein the center of the stem is positioned closer to a central axis of the downhole tool than an outer surface of the tapered slope.

16. The downhole tool of claim 15, wherein in the first mode the inner surface of the stem extends in a direction in parallel to a central axis of the downhole tool.

17. The downhole tool of claim 16, further comprising:

an elastic material positioned on the outer surface of the deformable element.

18. The downhole tool of claim 17, further comprising:

a sealing surface positioned between the deformable element and a tool mandrel, wherein the deformable element is a separate element from the tool mandrel.

19. The downhole tool of claim 17, wherein the ends of the deformable element has a maximum thickness of the deformable element.

20. The downhole tool of claim 16, wherein the tapered slope includes two angled ends.

21. The downhole tool of claim 16, wherein the tapered slope is positioned between the end of the deformable element and the center of the stem.

22. The downhole tool of claim 16, further comprising:

a retaining body with a ledge, wherein the end is configured to be positioned between a tool mandrel and the ledge.

* * * * *